US006442771B1

(12) United States Patent
Meier

(10) Patent No.: US 6,442,771 B1
(45) Date of Patent: Sep. 3, 2002

(54) FLUSHING DEVICE

(75) Inventor: Markus Meier, Winterhur (CH)

(73) Assignee: Geberit Technik AG, Jona (CH)

( * ) Notice: Subject to any disclaimer, the term of this patent is extended or adjusted under 35 U.S.C. 154(b) by 0 days.

(21) Appl. No.: 09/743,963

(22) PCT Filed: Jun. 9, 1999

(86) PCT No.: PCT/CH99/00248

§ 371 (c)(1),
(2), (4) Date: Apr. 30, 2001

(87) PCT Pub. No.: WO00/06842

PCT Pub. Date: Feb. 10, 2000

(30) Foreign Application Priority Data

Jul. 24, 1998 (CH) ..... 1576/98

(51) Int. Cl.[7] ..... E03D 9/10
(52) U.S. Cl. ..... 4/319; 4/323; 4/434
(58) Field of Search ..... 4/319, 434, 435, 4/441, 442, 321, 323

(56) References Cited

U.S. PATENT DOCUMENTS

| | | | | | |
|---|---|---|---|---|---|
| 2,414,964 A | * | 1/1947 | McPherson | ..... | 4/319 |
| 2,604,633 A | * | 7/1952 | McPherson | ..... | 4/319 |
| 3,259,917 A | | 7/1966 | Rascov | ..... | 4/319 |
| 3,727,241 A | | 4/1973 | Drouhard, Jr. et al. | ..... | 4/319 |
| 4,170,798 A | * | 10/1979 | Krumdieck | ..... | 4/319 |
| 4,955,091 A | * | 9/1990 | Grills et al. | ..... | 4/321 |
| 5,133,089 A | | 7/1992 | Tsutsui et al. | ..... | 4/300 |

FOREIGN PATENT DOCUMENTS

| | | | | | |
|---|---|---|---|---|---|
| AU | 7505774 A | | 5/1976 | | |
| FR | 348766 | * | 4/1905 | ..... | 4/442 |
| WO | 95/04196 | | 2/1995 | | |
| WO | 95/23261 | | 8/1995 | | |

* cited by examiner

*Primary Examiner*—Robert M. Fetsuga
(74) *Attorney, Agent, or Firm*—Browdy and Neimark

(57) ABSTRACT

The invention relates to a flushing device comprising a bowl (4) having a flushing module (5) which is arranged in the area of the bowl (4) designed to receive excreta. The flushing module (5) at an upper end has a first receiving area (12) for receiving flushing water (38) and excreta (74) as well as means with which said receiving area (12) can be emptied into a chamber (80) situated underneath it.

15 Claims, 4 Drawing Sheets

FLUSHING DEVICE

Figure 1:
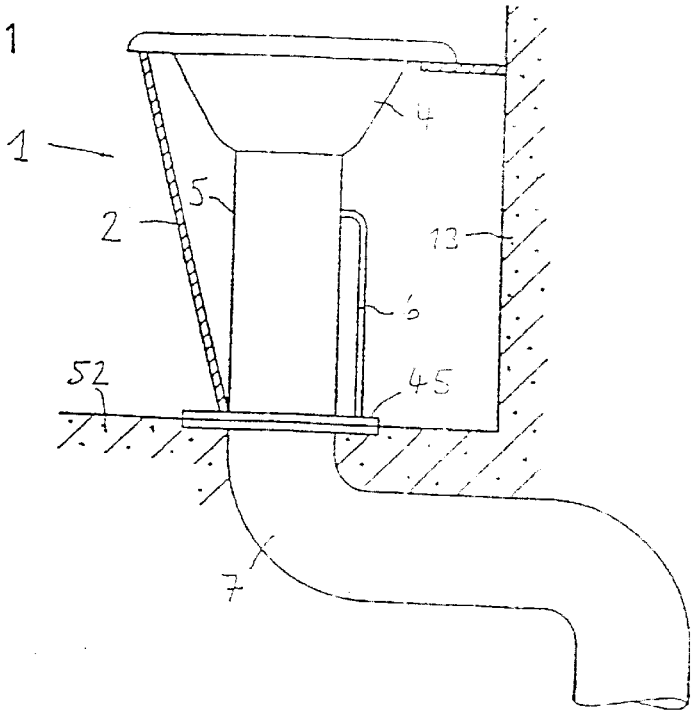

The present invention is concerned with a flushing device for a water closet incorporating a bowl. Very much and often expensive drinking water is used every day worldwide to flush water closets. For many years, extensive research has therefore been conducted in an attempt to reduce the amount of water consumed for the flushing of water closets. A significant contribution to this has been made with flush tanks that have an interruptible flush or a selectively activated partial flush. With the partial flush significantly less water is used for flushing after a small job than usual. Also known are flushing devices in which water is accelerated by means of a water nozzle during the flushing process in the siphon. A flushing device of this type is revealed, for instance, in the applicant's WO 95/04196. However, even here the minimum water consumption is at least three liters and the operative complexity is comparatively high. The pressure flushing device according to EP-A-0 352 712 operates in a similar manner.

Flushing devices are furthermore known in which water is suctioned out of the siphon of the water closet during flushing by means of a vacuum pump and a suction line. In railway cars, toilets are known that have a basin with an opening and a shutter below the same that can be swiveled off to the side. Since no effective odor closure is present here and none is needed, these toilets are not suitable for in-home use. Lastly, water closets are known in which the excreta are burned, composted or packaged. These water closets work without a flushing device and have so far proven useful only for special applications, for example in vehicles or on campgrounds. However, in the known flushing devices a shortcoming is presented not only by the high water consumption but also by the generated noise. The ideal flushing device would, therefore, operate without water and noiseless and would, furthermore, be germproof The invention now has as its object to create a flushing device of the above class that comes closer to this ideal design than the flushing devices that are known so far.

The object of the invention is met with a flushing device according to the preamble as per claim 1. In the inventive flushing device provision is thus made for a flushing module to be disposed in the excrement catch area of the bowl. In the inventive device, the flushing, in principle, thereby no longer takes place from the top, as until now, but from the bottom and with a module to be affixed to the underside of the bowl. It is now an essential feature that this prevents the previously unavoidable high energy loss due to friction of the flushing water in the flush tank, in the drain bend and in the bowl. The flushing water can be used directly and with less energy loss in the flushing module. Also avoided is the generation of noise in the flush tank, in the drain pipe and in the bowl. Since the flushing takes place underneath the bowl, in the module, the generation of noise can be dampened significantly more effectively than before.

It is also regarded as a significant aspect of the invention that the installation can be significantly simplified. This is based on the fact that the current multiple interfaces between the water closet and the building can often be reduced only by using a plug-in interface. The flushing module is mounted on the building floor by means of a mounting plate, for example, and the toilet bowl is subsequently fixed on the same.

In a further development of the invention, the flushing module has, at an upper end, a first catch area to receive flushing water and excreta, and means are provided by which the catch area can be emptied into a space disposed below the same. The excreta fall into this first catch area and are subsequently emptied into a space disposed below the same, for example into a collection container. The emptying is particularly effective if this takes place by a swiveling or tilting away. The swiveling away takes place, according to a further development of the invention, by rotating the catch area. The emptying thus takes place in a manner similar to known ashtrays in which a catch plate is rotated when a button is pressed, resulting in the ashes to be hurled away radially. The excreta then leave the catch area together with the flushing water that is present in this catch area. The emptying is particularly effective if a downward movement of the catch area occurs simultaneously with a rotation. A hydraulic drive is preferably provided for both movements. This becomes particularly simple and cost-effective from a design point of view if the catch area is connected to a hydraulic cylinder. By moving the piston of the cylinder, the catch area is then moved downward. Suitable guide means simultaneously exert a rotating movement onto the catch area during this downward movement.

In a further development, provision is made for the flushing module to form, together with a portion of the bowl disposed at a distance to the former, an odor trap in such a way that a space between the flushing module and this portion is filled with water. In this manner, an odor trap is formed that is very easy to build and cost-effective, as well as reliable. When the catch area is refilled with flushing water after a flush, this odor trap takes effect immediately and prevents odors from passing from the interior of the module into the bowl. It is now an essential feature that an odor trap of this type requires comparatively little water.

A particularly effective cleaning results when, according to a further development of the invention, nozzle openings are disposed approximately centrically in the catch area, through which flushing water can be sprayed radially outward. The emptying of the catch area is thus supported by the flushing water exiting through the nozzle openings. This exiting of this flushing water may be actuated by a downward movement of the catch area.

If, according to a further development of the invention, refining means are disposed underneath the catch area in said compartment, whereby feces may, for example, be reduced mechanically, the excreta can be collected in a second catch area in the form of a thick liquid. This area with the refining means can preferably be cleaned with high-pressure or steam nozzles and is can be[1] hermetically sealed on the bottom toward the sewer line.

1 Translator's note: the German-language sentence on which this translation is based contains either a grammatical error or superfluous words.

For installation purposes, the flushing module is preferably fixed as an entire unit on a standard interface plate with a quick lock. Located on this plate are the drain, a compressed water connection, as well as preferably also a power supply connection. The WC bowl can now be plugged onto the interface without additional installation costs and is immediately operable.

The invention is also concerned with a method for flushing a water closet. In this method the excreta are collected in a catch area that is disposed in a lower region of a toilet bowl and at least partly filled with water, and subsequently emptied from this area into a further area located underneath. As in the device, the underlying concept that the excreta are collected in a catch area and subsequently flushed there is an essential feature in the inventive method as well.

Further advantageous characteristics will become apparent from the dependent claims, from the following description and from the drawings.

Figure 2:
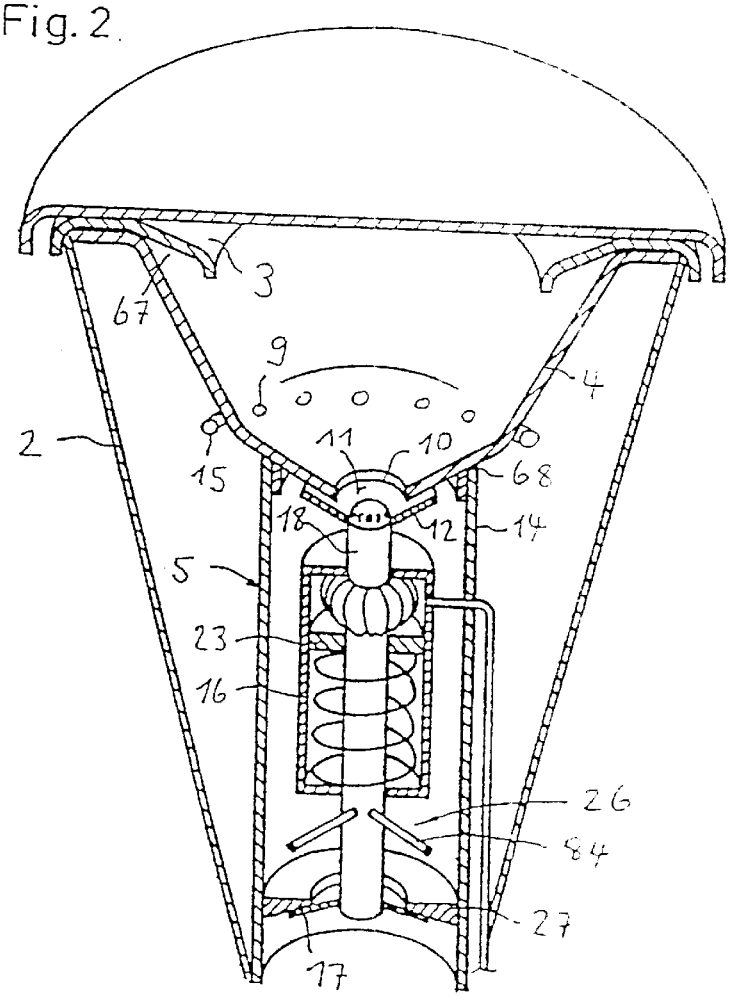
Figure 4:
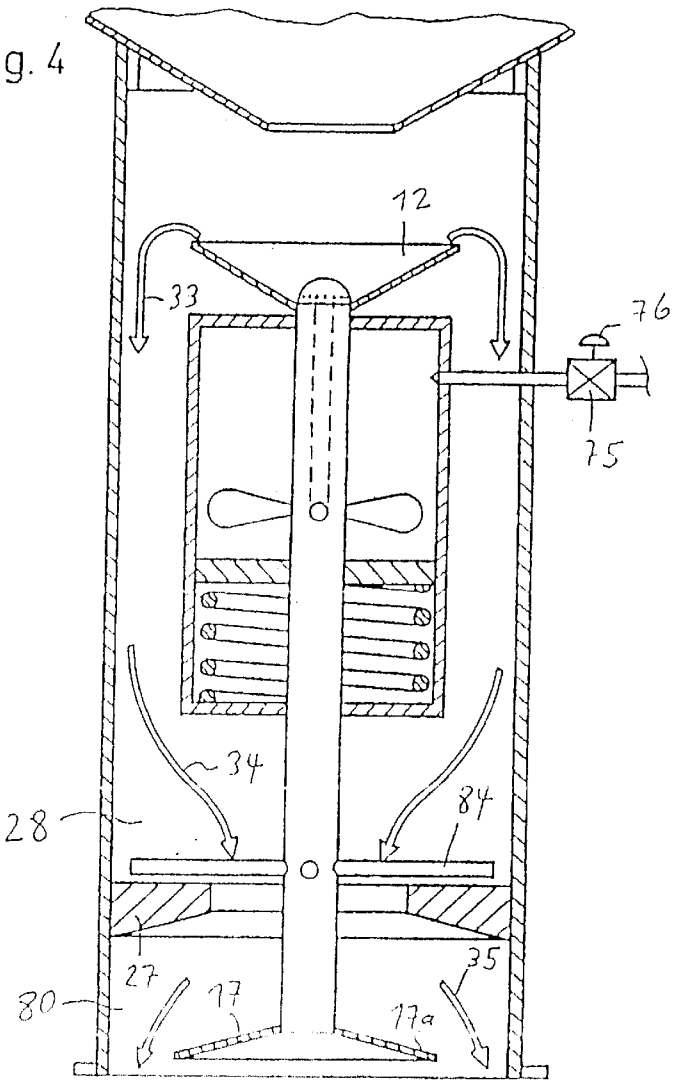
Figure 3:
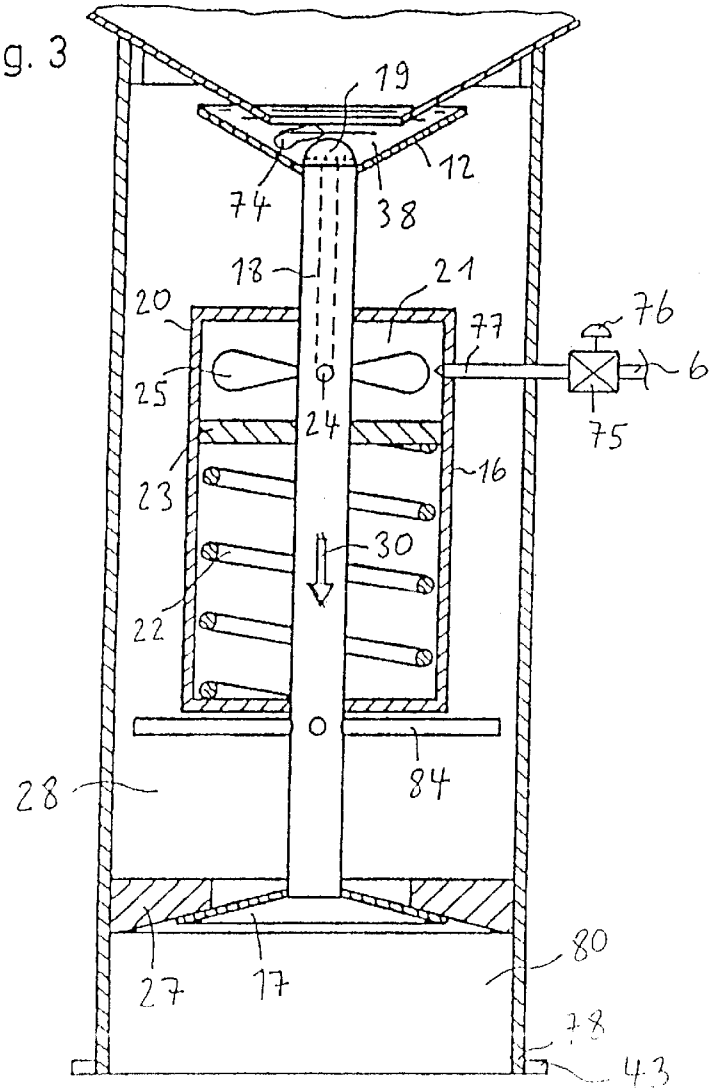
Figure 5:
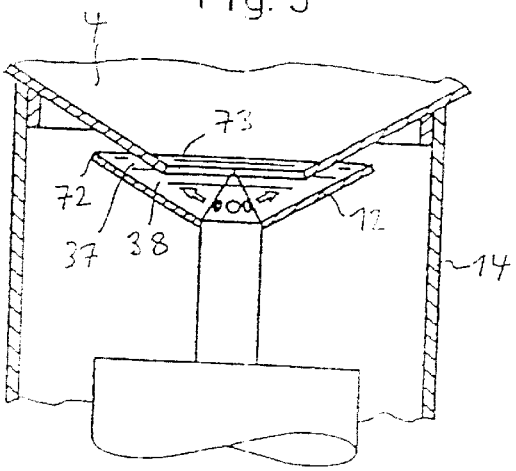
Figure 6:
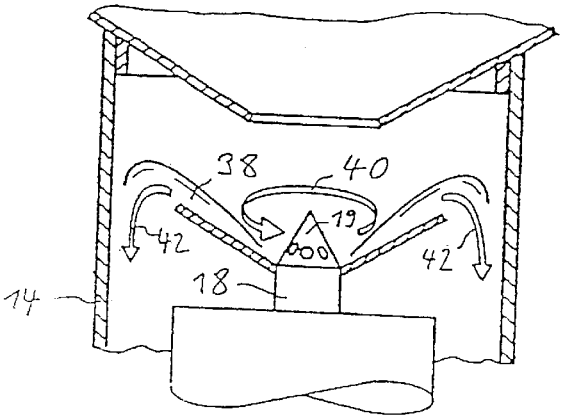
Figure 7:
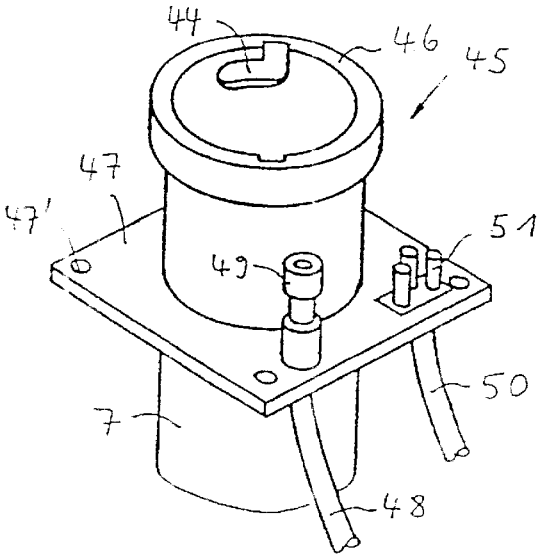
Figure 8:
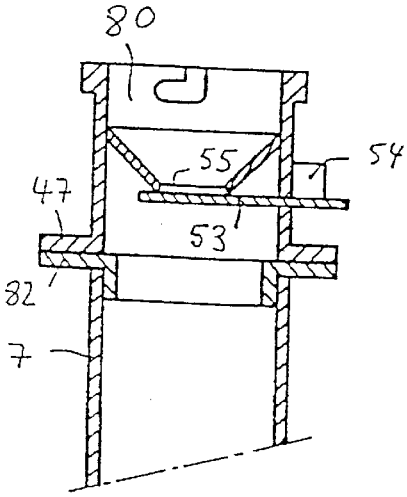
Figure 9:
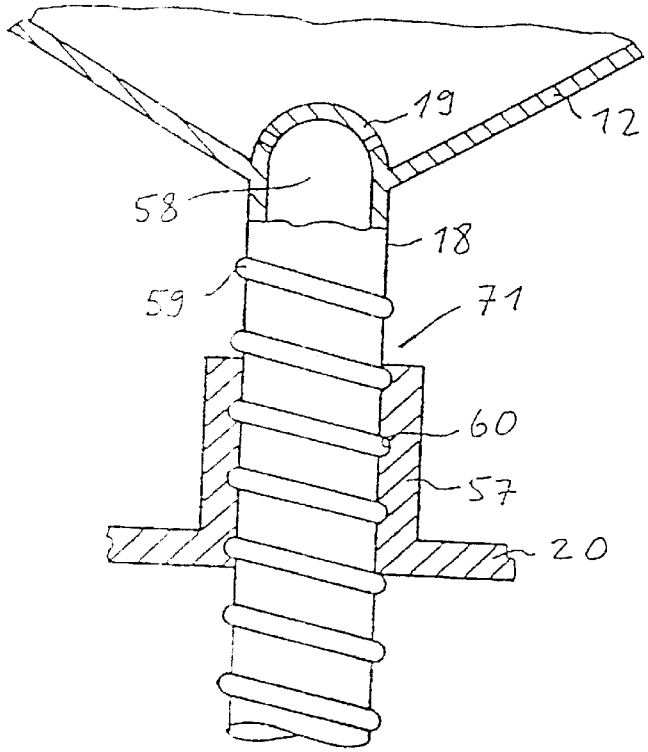
Figure 10:
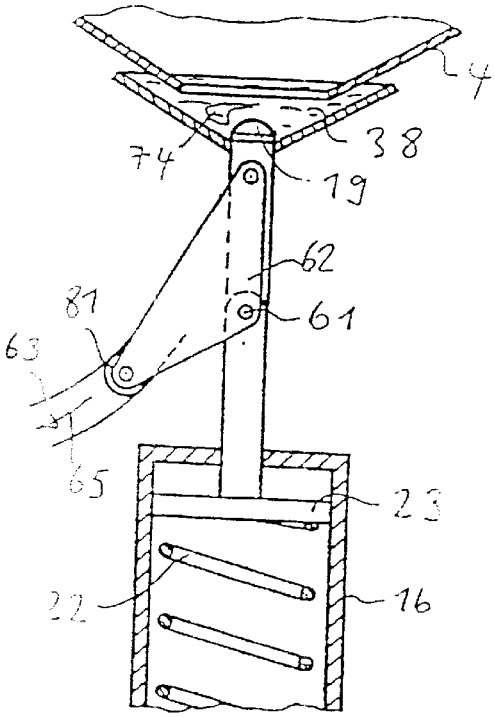
Figure 11:
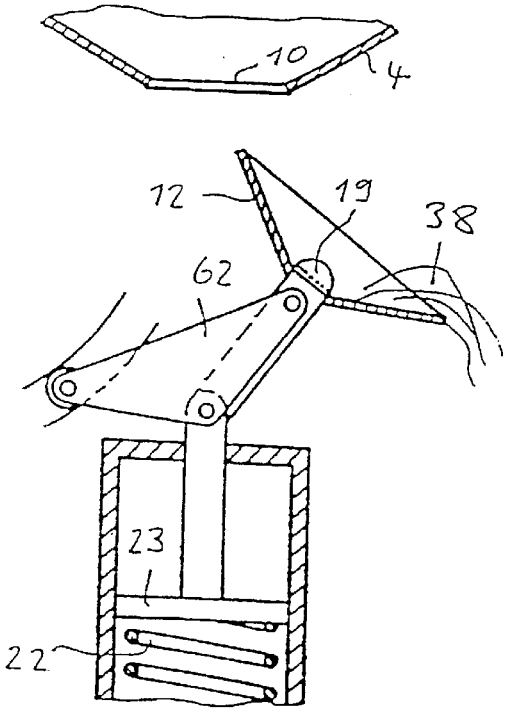

Embodiments of the invention will subsequently be explained in more detail based on the drawings, in which:

FIG. 1 schematically shows a partially sectioned view of an inventive flushing device, FIG. 2 shows a vertical section through an inventive flushing device, FIGS. 3 and 4 schematically show a partial section through an inventive flushing device, FIGS. 5 and 6 schematically show a partial section through the inventive flushing device to illustrate the emptying process, FIG. 7 schematically shows a view of a standard interface, FIG. 8 shows a section through the standard interface according to FIG. 7, FIG. 9 shows a partial section through the inventive flushing device, and FIGS. 10 and 11 schematically show a partial section through a variation of the inventive flushing device.

FIG. 1 shows a WC system 1 that stands on a building floor 52 and is supported at a building wall 13. It substantially comprises a basin 2, which is made of ceramics, plastic or metal, and a bowl 4 having an upper opening 67, as well as a flushing module 5 and a connecting plate 45. The connecting plate 45 connects the flushing module 5 to a drain line 7 that may be installed in the floor 52. The flushing module 5 is connected via a water line 6[2] a coupling 49 (FIG. 6) of the connecting plate 45 to a supply line 48 of the house plumbing. A seat ring 3 is disposed on the basin 2 above the opening 67.

2 Translator's note: it is not clear from the German-language document, whether only a comma or a word/words were omitted here.

As shown in FIG. 2, the bowl 4 has at its lower end an opening 10, which may be circular, for example. Above this opening 10, a plurality of openings 9 are disposed in a circle, which are connected to a circular pipe 15. This circular pipe 15 is connected by means of a valve not shown here to the supply line 48. When the valve is open water flows through the openings 9 onto the inside of the bowl 4 and cleans the same.

Located below the opening 10 is a comparatively flat dish 12 that forms a catch area. The dish 12 may also be made of ceramics. However, other materials are possible here as well, for example plastic or metal, which are preferably coated on their upper side 11 to reduce adherence. A suitable material for the reduction of adherence is tetrafluroethylene, for example. Fixed to the underside of the dish 12 is a vertical pipe 18, which is connected to a piston 23 of a water cylinder 16. With this water cylinder 16 the dish 12 can be moved downward.

The water cylinder 16 is located in a cylindrical collection container 14, which is firmly connected at its upper edge 68 to the outside of the bowl 4. A bayonet-type coupling is suitable for this connection, for example. The connection is designed gasproof and has, for example, a gasket, which is not shown here.

Disposed in the lower region of the collection container 14 is a refining device 26. It substantially comprises a propeller 84 that is fixed on the pipe 18. If the pipe 18 is moved downward, as explained above, the propeller 84 is rotated simultaneously, for example with the rotation device 71 shown in FIG. 9. Furthermore disposed below the propeller 84 on the pipe 18 is a sealing plate 17 which, when the dish 12 is not lowered, sits against an inwardly directed edge 27 of the collection container 14 as shown in FIG. 3.

The collection container 14 is connected at its lower edge 78 to an edge 46 (FIG. 7) of the connecting plate 45 in a gasproof manner. The connection is a bayonet-type coupling, for example, that has laterally projecting shoulders 43 on the collection container 14 as shown in FIG. 3, which engage into corresponding cutouts 44 (FIG. 7) of the connecting plate 45. The module 5 is thus releasably connected in a gasproof manner at its upper end to the bowl 4 and at its lower end to the connecting plate 45.

As shown in FIG. 5, the dish 12 is filled with water 38. The dish 12 is designed such that its upper edge 72 is located above the edge 73 of the opening 10. The dish 12 is then positioned such that a space 37, which is filled at least partly with water, exists between the underside of the bowl 4 and the inside of the dish 12. Together with the water, this space 37 forms an odor trap, which seals the bowl 4 and the dish 12 against one another in a gasproof manner.

Gas located in the interior of the collection container 14 can thus not get into the interior of the bowl 4.

The dish 12 has centrically and on its upper side at least one spray nozzle 19 that is connected to an interior space 58 of the pipe 18 as shown in FIG. 9. As will be explained in more detail further below, water can be introduced through this spray nozzle 19 into the interior of the dish 12 to clean the same.

The method of operation of the inventive flushing device will be explained in greater detail below based on the FIGS. 3 and 4. As already mentioned above, the dish 12 forms a catch area. After using the WC system 1, the excreta 74 are located in the dish 12 and thus in the water 38. To activate a flush, the lever 76 is operated, which is shown here schematically, and a water valve 75 is thereby opened. The valve 75 is located in the line 6. When the valve 75 is open, water flows under pressure into an upper pressure compartment 21 of the water cylinder 16. An inlet nozzle 77 is oriented such that it is directed onto a turbine 25 that is fixed on the pipe 18. The pressure compartment 21 is thereby filled with water and the piston 23 is moved downward with the pipe 18 against the power of recoil of the spring 22 in the direction of the arrow 30. The dish 12 accordingly moves downward into the position shown in FIG. 4. With an opening 24 in the pipe 18, water simultaneously flows into the pipe 18 and through the spray nozzle 19 into the dish 12. Also simultaneously, the pipe 18 is rotated with the dish 12 due to the effect of the water onto the turbine 25. The dish 12 thus moves under rotation from the position shown in FIG. 3 into the position shown in FIG. 4. Once the position of the piston 23 shown in FIG. 4 is reached, a sensor, which is not shown here, closes the valve 75. The spring under tension 22 now moves the piston 23 with the pipe 18 as well as the dish 12 back up into the position shown in FIG. 3. The water in the pressure compartment 21 is displaced through the opening 24 and the nozzle 19 into the dish 12, causing the same to be filled again. At the same time flushing water flows via the circular pipe 15 and the openings 9 into the bowl 4, cleaning it on the inside.

As a result of the rotation of the dish 12, the downward movement, and the water discharged through the spray opening 19, the dish 12 is emptied, as illustrated by FIG. 6. The dish 12 is moved slightly downward here and rotated in the direction of the arrow 40 around the axis of the pipe 18. This rotation generates a centrifugal force onto the water 38 and the excreta 74 and transports same in the direction of the arrows 42 over the edge of the dish 12 into the collection container 14. This movement is supported by the water spraying from the nozzle 19. The water is thus forcefully dumped out of the dish 12 and the excreta 74 fall downward inside the collection container 14 into a refining compartment 28 (FIG. 3). In FIG. 4 this falling process is indicated by the arrows 33 and 34. Once the excreta 74 have arrived in the refining compartment 28, they are chopped up by the propeller 84, which rotates along with the pipe 18. The odor plate 17 is now lifted with its sealing edge 17a off the sealing flange 27 so that the water and the chopped up excreta 74 move down further into the holding compartment 80 shown in FIG. 8, in the direction of the arrow 35. The water and the refined excreta form a thick liquid.

In the holding compartment 80, water and the excreta may be collected from a plurality, for example three to five, flushes. One flush requires, for example, approximately one liter of water. If the holding compartment 80 is filled, for example, with three to five liters of thick liquid, a slide 53, which releases a round opening 55, is activated, for example by means of a sensor not shown here that switches on a drive 54. The thick liquid then enters through the opening 55 into the drain pipe 7. After the emptying process, the slide 53 re-closes the opening 55 and forms an odor trap.

The refining device 26 and the holding compartment 80 can be cleaned with high-pressure or steam nozzles not shown here.

The pipe 18 is rotated, as explained, by the turbine 25. Also conceivable, however, as an alternative to the turbine 25, is a rotation device 71 according to FIG. 9. In this rotation device 71, the pipe 18 has, on its outside, helical ribs 59 that engage into corresponding cutouts 60 of a flange 57 of the cylinder housing 20. When the pipe 18 is moved downward, the pipe 18 inevitably rotates the flange 57. When the pipe 18 is pushed back up by the spring 22, the dish 12 accordingly rotates in the opposite direction. This rotating movement, together with the water flowing out of the nozzle 19, also has a cleaning effect by which the inside 11 of the dish 12 is cleaned. The cleaning is supported by a non-stick or low-adhesion inside 11 of the dish 12. Low-adhesion materials are ceramics, for example, in a known manner. However, the adhesion may also be reduced by suitable plastics.

In the above discussed embodiment, the dish 12 is moved downward during the flushing process and rotated at the same time. In the embodiment shown in FIGS. 10 and 11, the dish 12 is moved downward and tilted. This is achieved by means of a guide rod 62 fixed at the underside of the dish 12 and connected via a hinge 61 to the piston 23 of the water cylinder 16. At the lower end of the angled rod 62, a guide roller 81 is disposed, which is movably disposed in a fixed guide groove 63. If the rod 62 is moved downward in the direction of the arrow 64, the guide roller 81 moves in the direction of the arrow 65 and tilts the rod 62 with the dish 12 in a clockwise direction around the hinge 61 into the tilted position shown in FIG. 11. The water 38 and the excreta 74 are thereby dumped out of the dish 12 and move, just as explained above, downward inside the collection container 14 and to the refining device 26. Water can simultaneously be introduced into the dish 12 via the spray nozzle 19, thereby cleaning the bowl. After the flushing process the spring 22 moves the piston 23 upward. The rod 62 is then moved back into the position shown in FIG. 10. At the same time the dish 12 is refilled with water via the spray nozzle 19. When the dish 12 is filled with water, the odor trap is formed between the dish 12 and the bowl 4, as explained above. The toilet system 1 is then immediately ready to be used again.

As explained, the connecting plate 45 forms a single interface between the WC system 1 and the building. After the connecting plate 45 has been installed the module 5 is plugged onto the edge 46 and connected with the above bayonet-type connection. At the same time a water supply connection is established with the coupling 49. At the same time an electrical line 50 can be connected to the module 5 via a plug 51. This electrical line 50 may be used to supply, for example, sensors and valves. Also conceivable is a supply to additional appliances. The mounting of the connecting plate 45 takes place, for example, by means of a plate 47, which is provided with four holes 47'. From these holes 47' the connecting plate 45 is fixed on the floor 52 by means of bolts not shown here. The connection of the connecting plate 45 to the drain line 7 takes place, for example, via a flange 82 that is mounted on the underside of the plate 47.

In the inventive flushing device the flushing thus does not take place in the usual manner by flooding, instead cleaning nozzles are used in a targeted manner to thus take advantage of the water pressure. The water trap to the sewer line is attained with a comparatively thin layer 38 of water. Comparatively large quantities of water therefore do not need to be moved during flushing. After the refinement there are essentially no solids left. This prevents that comparatively large quantities of water are needed, as in the past, to generate a bow wave for the transportation of solids. The flushing device can substantially be reduced to a flushing module, permitting a quick and simple installation.

What is claimed is:

1. A flushing device for a water closet (1) incorporating a bowl (4), comprising a flushing module (5) that incorporates, underneath the bowl (4), an excrement catch area (12) that is rotatable during flushing to be emptied, wherein the excrement catch area (12) is downwardly movable and simultaneously rotatable to be emptied into a compartment (80) disposed therebelow, and wherein a hydraulic cylinder (16) is provided by which the catch area (12) is downwardly movable to be emptied.

2. A flushing device according to claim 1, wherein at least one of the catch area (12) and the bowl (4) incorporates means (19, 9) by which water is introducible into the catch area under pressure for emptying and cleaning.

3. A flushing device according to claim 1, wherein the catch area (12) is emptyable into a compartment (80) disposed below same.

4. A flushing device according to claim 1, wherein the flushing device module (5) forms, together with a portion (73) of the bowl (4) disposed at a distance to the flushing module (5), an odor trap in such a way that a space (37) between the flushing module (5) and said portion (73) is filled with water.

5. A flushing device according to claim 1, wherein at least one of the catch area (12) and the bowl (4) incorporates means (19,9) by which water is introduceable into the catch area under pressure for emptying and cleaning.

6. A flushing device for a water closet (1) incorporating a bowl (4), comprising a flushing module (5) having, at an upper end thereof, a first catch area (12) to receive flushing water (38) and excreta (74), means by which the catch area (12) can be emptied into a compartment (80) disposed below the catch area, wherein at least one of said catch area (12) and said bowl (4) incorporates means (19, 9) by which water is introducible into the catch area under pressure for emptying and cleaning, and nozzle openings (19) disposed approximately centrally in the catch area (12) through which flushing water is sprayable in radially outward direction.

7. A flushing device for a water closet (1) having a bowl (4), comprising a module (5) connected to a bottom opening (10) of said bowl (4), a catch area (12) disposed at an upper end of said module (5) to receive excreta, said module (5) incorporating connecting means (43) fixable on a connecting plate (45) during installation, said module (5) being connected through a formed locking connector to said connecting plate (45).

8. A flushing device according to claim 7, wherein said the module (5) is to be connected to a water line (48) and wherein the catch area (12) is flushable with the water from the water line (48).

9. A flushing device according to claim 8, wherein the catch area (12) is rotatable or tiltable with the water from the water line (48).

10. A flushing device for a water closet (1) having a bowl (4), comprising a module (5) connected to a bottom opening (10) of said bowl (4), a catch area (12) disposed at an upper end of said module (5) to receive excreta, said module being adapted to be connected to a water line (48) wherein said catch area (12) is flushable with water from the water line, said catch area (12) being rotatable with water from the water line.

11. The flushing device according to claim 10 wherein said catch area (12) is simultaneously rotatable and movable in a downward direction with the water from the water line.

12. The flushing device of claim 10 further comprising a substantially cylindrical casing (14), wherein said catch area (12) is disposed in an upper opening of said casing (14).

13. A flushing device for a water closet (1) incorporating a bowl (4), comprising a flushing module (5) that incorporates, underneath the bowl (4), an excrement catch area (12) that is rotatable during flushing to be emptied, wherein the excrement catch area (12) is downwardly movable and simultaneously rotatable to be emptied;

wherein a hydraulic cylinder (16) is provided by which the catch area (12) is downwardly movable to be emptied;

wherein the piston (23) of the hydraulic cylinder (16) is connected with a rod or a pipe (18,62) to the catch area(12); and wherein nozzle openings (19) are disposed approximately centrically in the catch area (12) through which flushing water is sprayable in a radially outward direction.

14. A flushing device for a water closet (1) incorporating a bowl (4), comprising a flushing module (5) that incorporates, underneath the bowl (4), an excrement catch area (12) that is rotatable during flushing to be emptied, wherein the refining device (26) incorporates a rotatable mechanical part (84) similar to a propeller.

15. A flushing device for a water closet incorporating a bowl comprising a flushing module disposed in an excrement catch area of the bowl, and a refining device disposed below said catch area, by which flushing water as well as excreta are refinable, to form a thick liquid, wherein the refining device incorporates a rotatable mechanical part similar to a propeller, wherein the refining device is connected to a catch area and rotates therewith.

* * * * *